US010762860B2

(12) United States Patent
Minaki et al.

(10) Patent No.: US 10,762,860 B2
(45) Date of Patent: Sep. 1, 2020

(54) DEVICE AND METHOD FOR DRIVING DISPLAY PANEL

(71) Applicant: SYNAPTICS INCORPORATED, San Jose, CA (US)

(72) Inventors: Tomoo Minaki, Tokyo (JP); Hirobumi Furihata, Tokyo (JP); Takashi Nose, Tokyo (JP)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 16/582,800

(22) Filed: Sep. 25, 2019

(65) Prior Publication Data

US 2020/0118504 A1 Apr. 16, 2020

(30) Foreign Application Priority Data

Oct. 10, 2018 (JP) ..... 2018-192159

(51) Int. Cl.
*G09G 3/36* (2006.01)
*G09G 3/3258* (2016.01)

(52) U.S. Cl.
CPC ..... *G09G 3/3607* (2013.01); *G09G 3/3258* (2013.01); *G09G 2310/027* (2013.01)

(58) Field of Classification Search
CPC ..... G09G 3/3607; G09G 3/3258; G09G 2310/027
See application file for complete search history.

(56) References Cited

U.S. PATENT DOCUMENTS

2017/0148396 A1* 5/2017 Chen ..... G09G 3/2003
2018/0025683 A1* 1/2018 Oh ..... G09G 3/3233 345/690
2018/0211577 A1* 7/2018 Pan ..... G09G 3/3208
2019/0019474 A1* 1/2019 Jun ..... G06F 3/1446

* cited by examiner

*Primary Examiner* — Andrew Sasinowski
(74) *Attorney, Agent, or Firm* — Patterson + Sheridan, LLP

(57) ABSTRACT

A display driver comprises image processing circuitry and drive circuitry. The image processing circuitry is configured to output display image data representing a display image comprising an effective area to be displayed in a display area of a display panel and an invalid area not to be displayed in the display area. The drive circuitry drives the display panel based on the display image data comprising effective pixel data associated with first pixels included in the effective area and invalid pixel data associated with second pixels included in the invalid area. Effective pixel data associated with first pixels located within a boundary area adjacent to the invalid area is set to first grayscale values. The invalid pixel data associated with second pixels located within an insert area defined in the invalid area is set to second grayscale values comprising a value different from the first grayscale values.

20 Claims, 8 Drawing Sheets

DEVICE AND METHOD FOR DRIVING DISPLAY PANEL

CROSS REFERENCE

This application claims priority to Japanese Patent Application No. 2018-192159, filed on Oct. 10, 2018, the disclosure of which is incorporated herein by reference in its entirety.

BACKGROUND

Field

Embodiments disclosed herein generally relate to a device and method for driving a display panel.

Description of the Related Art

A pixel-arranged area of a display panel, such as an organic light emitting diode (OLED) display panel and a liquid crystal display (LCD) panel, may be imperfectly rectangular. For example, corners of the pixel-arranged area may be rounded, and/or a notch in which no pixels are arranged may be included in the display panel.

SUMMARY

In one or more embodiments, a display driver comprises image processing circuitry and drive circuitry. The image processing circuitry is configured to output a display image data representing a display image comprising an effective area to be displayed in a display area of a display panel and an invalid area not to be displayed in the display area. The drive circuitry is configured to drive the display panel based on the display image data. The display image data comprises: effective pixel data associated with first pixels in the effective area; and invalid pixel data associated with second pixels in the invalid area. Ones of the effective pixel data associated with at least some of the first pixels are set to first grayscale values, the at least some of the first pixels falling within a boundary area adjacent to the invalid area. Ones of the invalid pixel data associated with ones of the second pixels are set to second grayscale values, the ones of the second pixels falling within an insert area defined in the invalid area. The second grayscale values comprise a value different from the first grayscale values.

BRIEF DESCRIPTION OF THE DRAWINGS

So that the manner in which the above recited features of the present disclosure may be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

DETAILED DESCRIPTION

Figure 1:
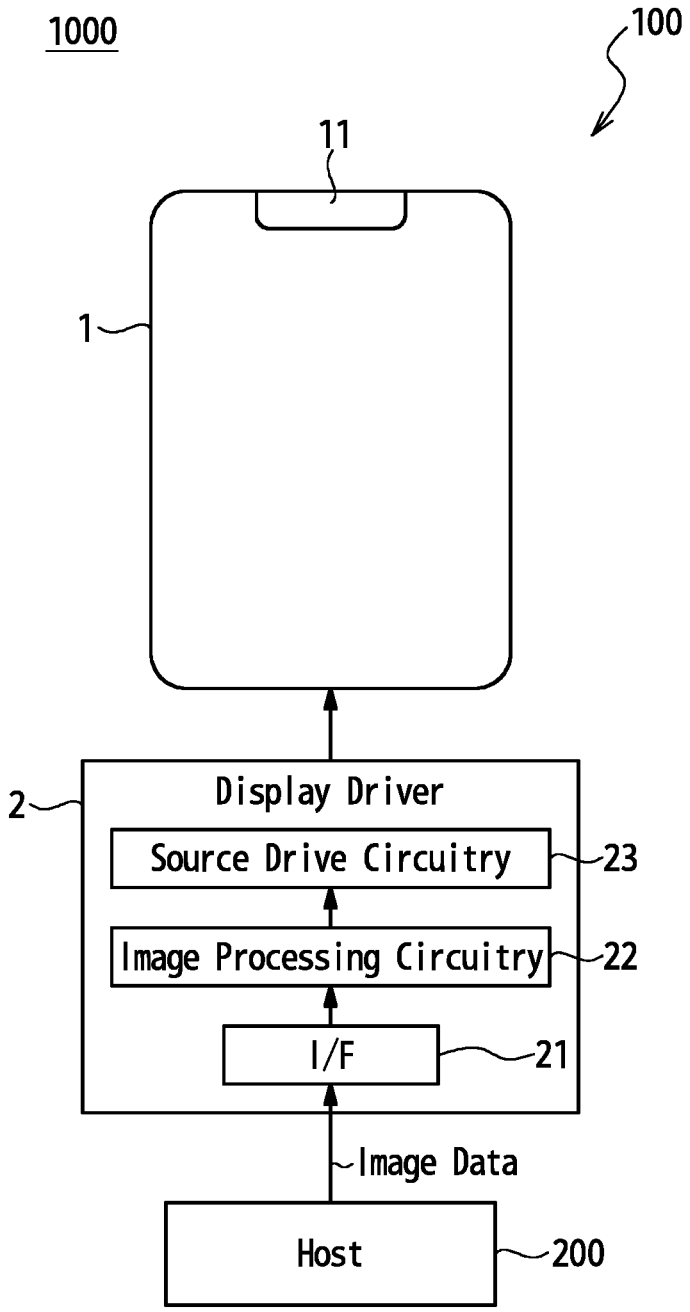
FIG. 1 illustrates an example configuration of a display system, according to one or more embodiments.

In one or more embodiments, as illustrated in FIG. 1, a display system 100 comprises a display module 100 and a host 200. In one or more embodiments, the display module 100 comprises a display panel 1 and a display driver 2. Examples of the display panel 1 may include organic light emitting diode (OLED) display panels and liquid crystal display (LCD) panels, among other display panels configured to supply a power source voltage to respective pixels. In one or more embodiments, the display module 100 is configured to receive an image data from an external host 200 and display the image data on the display panel 1.

In one or more embodiments, a display area of the display panel 1, in which pixels are disposed, is not rectangular. For example, the corners of the display area of the display panel 1 may be rounded and/or a notch 11 is formed along one side of the display area.

In one or more embodiments, the display driver 2 is configured to obtain the image data from the host 200 and drive respective pixels of the display panel 1 based on the obtained image data. In one or more embodiments, the image data comprises pixel data describing grayscale values of the respective pixels. In one or more embodiments, the display driver 2 comprises an interface 21, image processing circuitry 22, and source drive circuitry 23. In one or more embodiments, the interface 21 comprises interface circuitry configured to receive the image data from the host 200 and forward the same to the image processing circuitry 22. In one or more embodiments, the image processing circuitry 22 is configured to perform image processing on the image data received from the host 200. In one or more embodiments, the image processing performed by the image processing circuitry 22 comprises processing adapted to the non-rectangular shape of the display area of the display panel 1. In one or more embodiments, the source drive circuitry 23 is configured to receive a display image data obtained through the image processing by the image processing circuitry 22 and drive the respective pixels of the display panel 1 based on the display image data.

Figure 2:
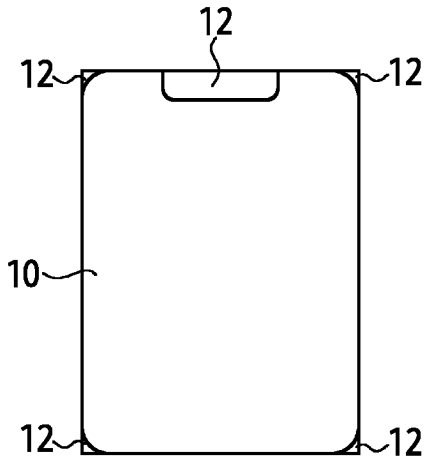
FIG. 2 illustrates an example image data received from a host, according to one or more embodiments.

In one or more embodiments, the host 200 is configured to generate the image data, which represents the image to be displayed on the display panel 1, and supply the same to the display driver 2. In one or more embodiments, the image represented by the image data does not have a shape that matches the non-rectangular display area of the display panel 1; the image represented by the image data is rectangular and circumscribes the display area of the display panel 1 as illustrated in FIG. 2. In one or more embodiments, the image represented by the image data comprises an effective area 10 and invalid areas 12. In one or more embodiments, the effective area 10 is displayed in the display area of the display panel 1, and the invalid areas 12 are not displayed on the display panel 1; no pixels in the display panel 1 are associated with the invalid areas 12 in the image represented by the image data. In one or more embodiments, the image data comprises effective pixel data associated with pixels in the effective area 10 and invalid pixel data associated with pixels in the invalid areas 12.

In one or more embodiments, the display driver 2 is configured to output drive signals to the display panel 1 based on the image data received from the host 200, which represents a rectangular image, while the display area of the display panel 1 is not actually rectangular. In one or more embodiments, the invalid areas 12 are not displayed on the display panel 1 since no corresponding pixels are disposed on the display panel 1; only the effective area 10, for which corresponding pixels are disposed on the display panel 1, is displayed.

Figure 3:
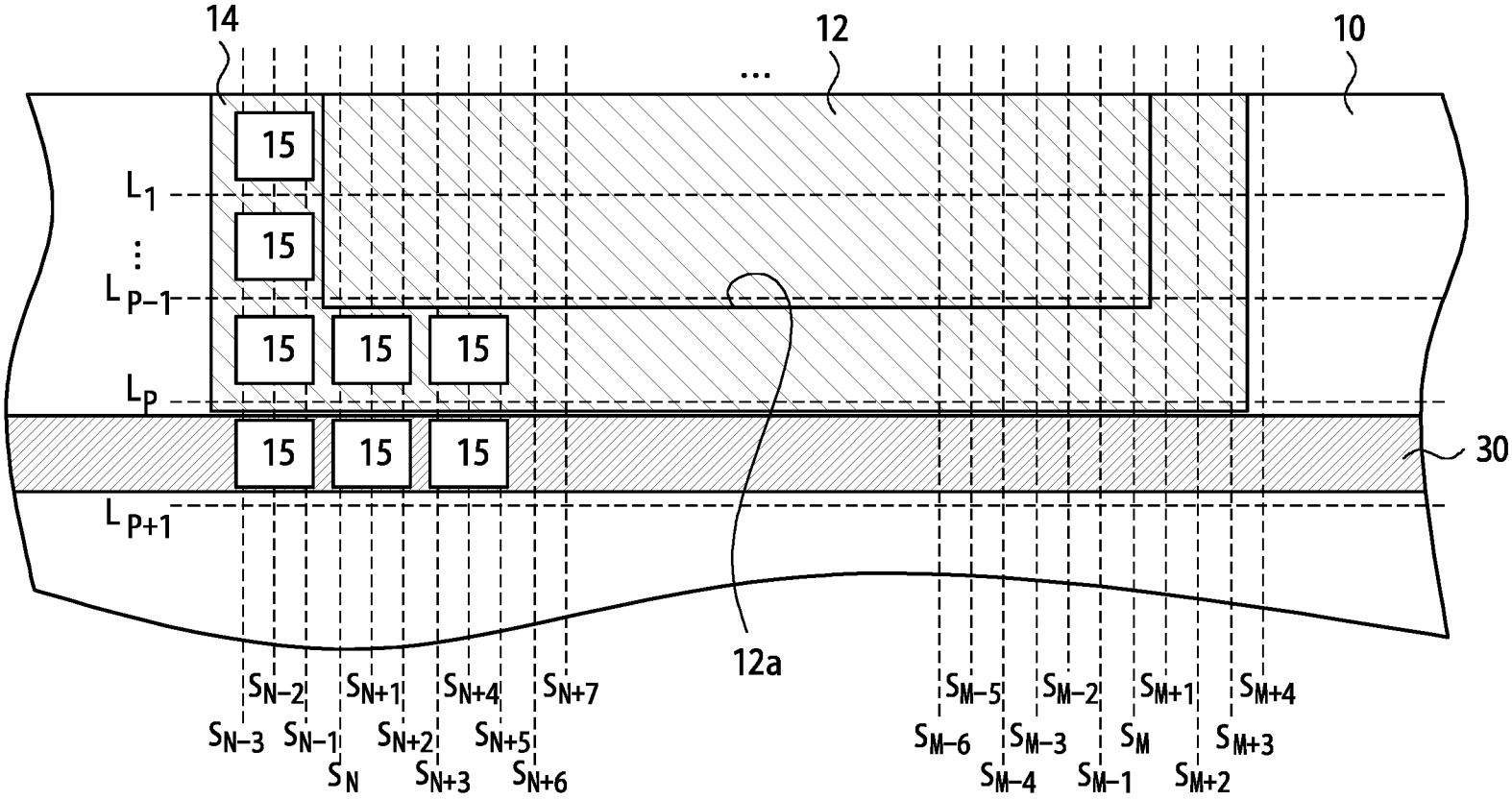
FIG. 3 illustrates an example image data which causes display of a line, according to one or more embodiments.

In one or more embodiments, the image processing circuitry 22 is configured to perform image processing to make the edges of the display area of the display panel 1 appear smooth. In one or more embodiments, as illustrated in FIG. 3, this image processing involves setting effective pixel data associated with the pixels in boundary areas 14 to first grayscale values corresponding to black or the like. Accordingly, the boundary areas 14 may be portions of the effective area 10 adjacent to the invalid areas 12. In one or more embodiments, the first grayscale values are equal to the allowed minimum grayscale value. In one or more embodiments, the first grayscale values are grayscale values to achieve displaying with low brightness levels on the display panel 1.

In one or more embodiments, when the pixel data associated with the pixels that fall within the entirety of the boundary areas 14 and the invalid areas 12 are set to the first grayscale values in the image data, a straight line 30 extended in an extending direction of the scan lines L may be displayed as illustrated in FIG. 3. This line 30 may be displayed as a dark line, because the pixels on the line 30 are displayed with darker brightness levels compared with the display image data. Alternatively, the line 30 may be displayed as a bright line, because the pixels on the line 30 are displayed with brighter brightness levels compared with the display image data. The line 30 may appear especially when the boundary between the effective area 10 and an invalid area 12 comprises a line segment 12*a* parallel to the extending direction of the scan lines L. In one or more embodiments, when the pixel data associated with the pixels in the boundary areas 14 and the invalid areas 12 are set to the first grayscale values, which correspond to black or the like, voltages applied to source lines $S_{N-3}$ to $S_{M+3}$ may largely change. For example, the voltages applied to source lines $S_{N-3}$ to $S_{M+3}$ may change when the display panel 1 is switched from a state in which pixels 15 connected to a scan line $L_P$ are driven to a state in which pixels 15 connected to a scan line $L_{P+1}$ are driven, since the effective pixel data associated with the effective area 10 are set to grayscale values corresponding to the display image. This may cause a large change in the power source voltage VDD on a power source line which supplies the power source voltage VDD to the pixels 15 because of the coupling between the source lines S and the power source line, causing display of the line 30 on the display panel 1. Similarly, when the display panel 1 is switched from the state in which pixels 15 connected to the scan line $L_{P+1}$ are driven to the state in which pixels 15 connected to the scan line $L_P$ are driven, this may cause a large change in the power source voltage VDD on the power source line, causing display of the line 30 on the display panel 1.

Figure 4:
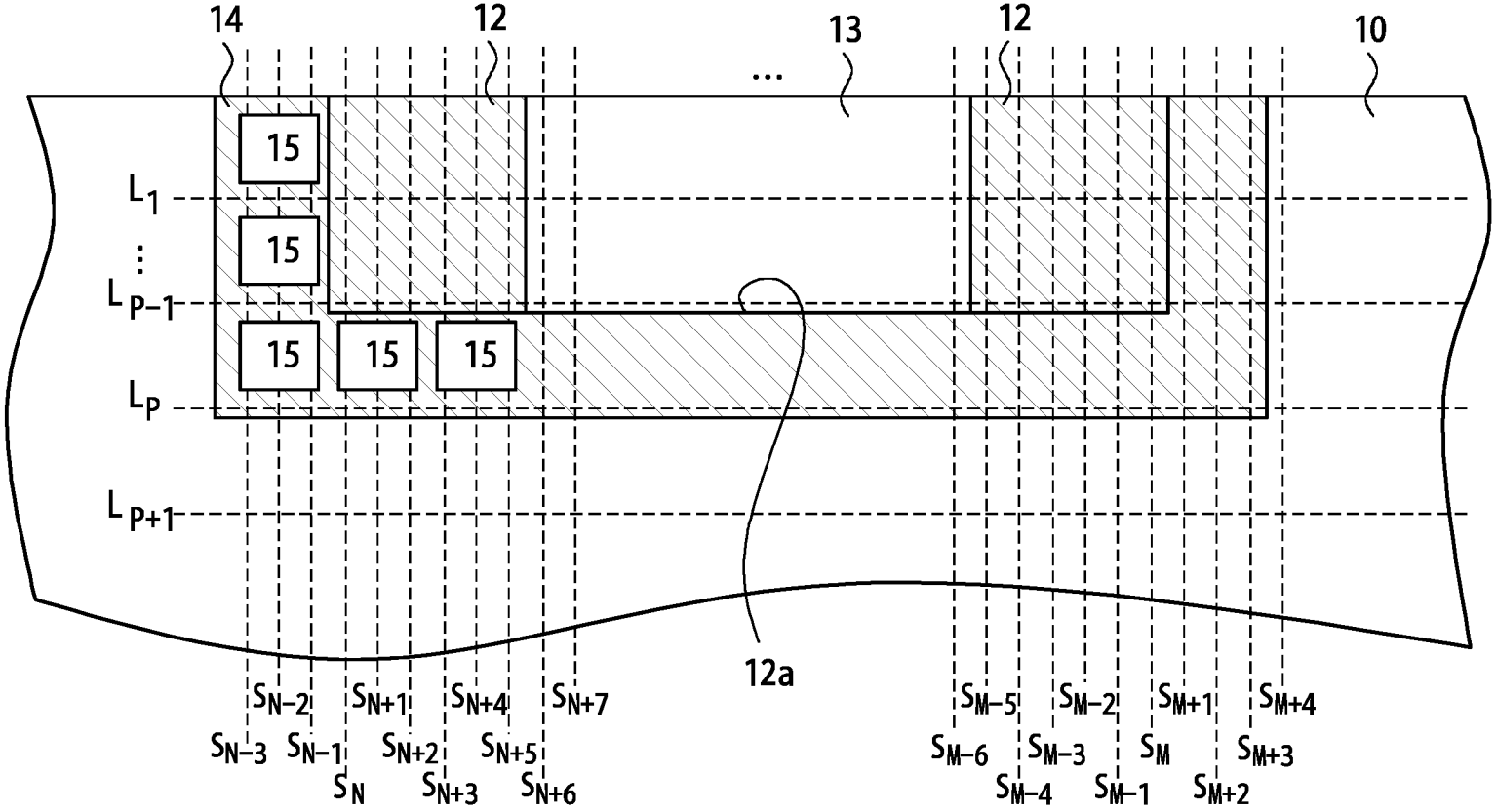
FIG. 4 illustrates an example image data which prevents display of a line, according to one or more embodiments.
Figure 5:
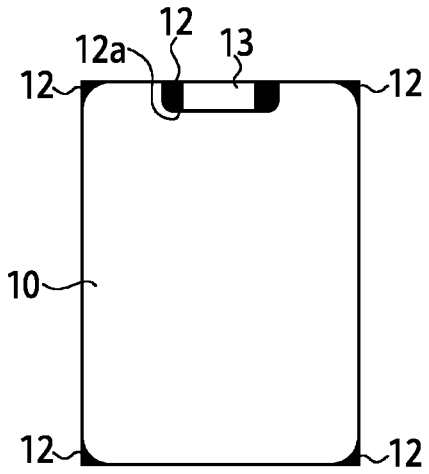
FIG. 5 illustrates an example image data obtained by image processing circuitry, according to one or more embodiments.

In one or more embodiments, to suppress the display of the line 30, the image processing circuitry 22 is configured to perform image processing on the image data to set invalid pixel data associated with an insert area 13 to second grayscale values such as white, where the insert area 13 is defined in an invalid area 12 as illustrated in FIGS. 4 and 5. This image processing suppresses changes in the voltages on the source lines $S_{N+6}$ to $S_{M-6}$ and thereby reduces changes in the power source voltage on the power source line potentially caused by the coupling with the source lines S. This effectively suppresses the display of the line 30.

In one or more embodiments, the second grayscale values set to the invalid pixel data of the insert area 13 may comprise a grayscale value different from the first grayscale values set to the effective pixel data of the pixels in the boundary area 14. In one or more embodiments, the second grayscale values are equal to the allowed maximum grayscale value. In one or more embodiments, the second grayscale values may be desired grayscale values determined to suppress the display of the line 30. In one or more embodiments, the second grayscale values may comprise the grayscale value which makes the brightness of the pixel 15 the highest. In one or more embodiments, the second grayscale values may be larger than the first grayscale values.

In one or more embodiments, the insert area 13 extends in the extending direction of the scan lines L along the top edge of the invalid area 12 and comprises pixels between the top edge and the bottom edge of the display panel 1. When the boundary between the effective area 10 and an invalid area 12 comprises a line segment 12*a* parallel to the extending direction of the scan lines L, for example, the insert area 13 may be aligned to at least a portion of the line segment 12*a* in the extending direction of the scan lines L. In one or more embodiments, the insert area 13 may fall within the range of the line segment 12*a* in the extending direction of the scan lines L. In one or more embodiments, the insert area 13 comprises at least some of the pixels of the invalid area 12, the at least some of the pixels being adjacent to the effective area 10.

In one or more embodiments, the first grayscale values set to the boundary areas 14 may be different from the first grayscale values set to the invalid areas 12. In one or more embodiments, the first grayscale values set to the boundary areas 14 may be dependent on the positions of the pixels associated therewith, or determined based on grayscale values (which may be also referred to as third grayscale values, hereinafter) set to the effective pixel data associated with the pixels in the boundary areas 14 in the image data received from the host 200. For example, the first grayscale values set to the boundary areas 14 may be determined by blending the received third grayscale values and a predetermined grayscale value with a predetermined ratio (such as a blending ratio), where the predetermined grayscale value may be the allowed minimum grayscale value or the allowed maximum grayscale value. In one or more embodiments, the first grayscale values set to the boundary areas 14 may be determined as grayscale values representing brightness levels determined by blending brightness levels displayed on the pixels 15 of the display panel 1 associated with the boundary areas 14 based on the received image data and a predetermined brightness level with a predetermined ratio (such as a blending ratio), where the predetermined brightness level may be the minimum brightness level or the maximum brightness level. In one or more embodiments, the predetermined ratio may depend on the positions of the associated pixels. In one or more embodiments, the predetermined ratio may depend on the number of subpixels in each of the pixels 15 of the display panel 1 associated with the boundary areas 14.

In one or more embodiments, effective pixel data associated with at least some of the pixels in a boundary area 14 may be set to the first grayscale values. For example, effective pixel data associated with pixels of a boundary area 14 other than the pixels adjacent to the line segment 12*a* may be set to the first grayscale values, where the line segment 12*a* is at the boundary parallel to the scan lines L between the effective area 10 and the invalid area 12.

Figure 6:
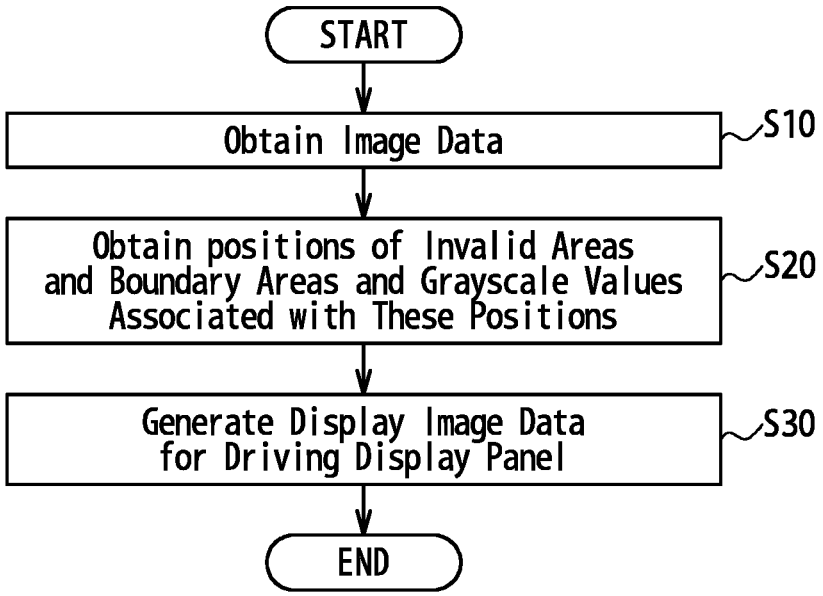
FIG. 6 is a flowchart illustrating example processing of the image processing circuitry, according to one or more embodiments.

In one or more embodiments, the image processing circuitry 22 operates as illustrated in FIG. 6. In one or more embodiments, the image processing circuitry 22 obtains an image data from the host 200 in step S10. In one or more embodiments, the image data obtained by the image processing circuitry 22 comprises invalid areas 12.

In one or more embodiments, in step S20, the image processing circuitry 22 obtains the positions of the invalid areas 12 and the boundary areas 14 in the display image data and grayscale values to be set to pixel data associated with the pixels in the invalid areas 12 and the boundary areas 14. Hereinafter, positions of pixels for which the image processing circuitry 22 determines grayscale values based on the shape of the display area of the display panel 1, more specifically, positions of pixels in the invalid areas 12 and the boundary areas 14 are referred to as "preset positions." In one or more embodiments, the preset positions and grayscale values to be set to pixel data associated with the preset positions are correlated with each other and registered in the image processing circuitry 22 in advance. In one or more embodiments, the positions of the pixels in the boundary areas 14 and the invalid areas 12 are registered based on the shape of the display area of the display panel 1. In one or more embodiments, the second grayscale values to be set to invalid pixel data associated with the insert area 13 that falls within an invalid area 12 are additionally registered in the image processing circuitry 22. The first grayscale values, which are to be set to pixel data associated with pixels in the boundary areas 14 and the invalid areas 12 other than the insert area 13, are additionally registered in the image processing circuitry 22. In one or more embodiments, the first grayscale values are equal to the allowed minimum grayscale value. In one or more embodiments, the second grayscale values are equal to the allowed maximum grayscale value.

In one or more embodiments, in step S30, the image processing circuitry 22 generates display image data used to drive the display panel 1 based on the obtained image data, the preset positions, and the grayscale values to be set to the pixel data associated with the preset positions. In one or more embodiments, the pixel data of the obtained image data associated with the preset positions are modified to the grayscale values registered in the image processing circuitry 22 to generate the display image data.

In one or more embodiments, the image processing circuitry 22 thus generates the display image data so that the pixel data associated with the pixels in the insert area 13 are set to the second grayscale values and the pixel data associated with the pixels in the invalid areas 12 other than the insert area 13 and the pixels in the boundary areas 14 are set to the first grayscale values. In one or more embodiments, the display panel 1 is driven by the source drive circuitry 23 based on the generated display image data.

Figure 7:
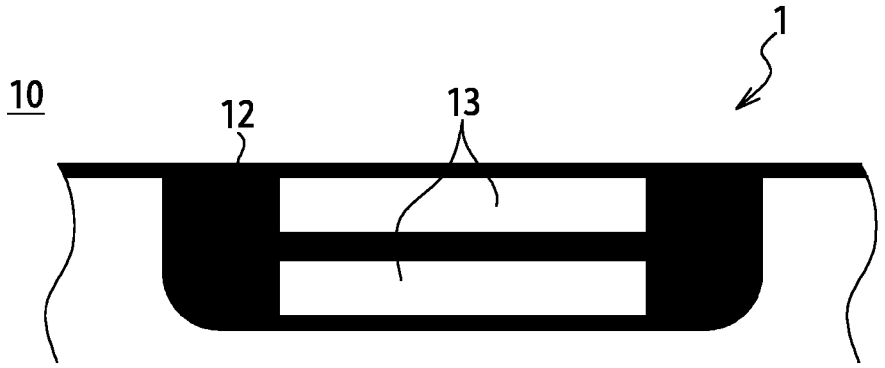
FIG. 7 illustrates one example shape of an insert area, according to one or more embodiments.
Figure 8:
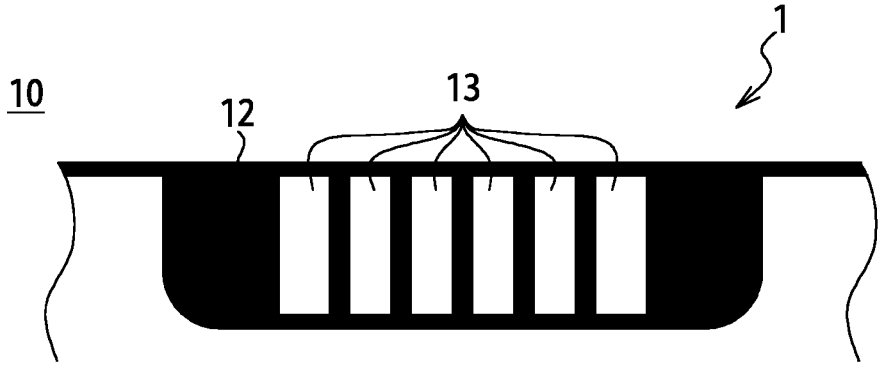
FIG. 8 illustrates one example shape of an insert area, according to one or more embodiments.
Figure 9:
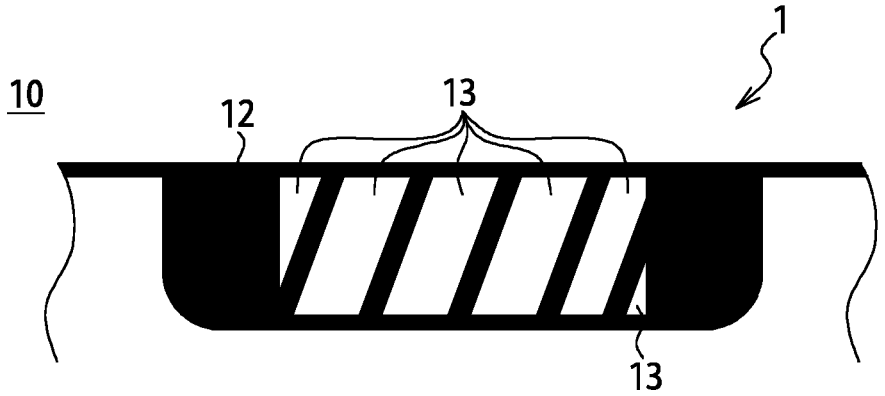
FIG. 9 illustrates one example shape of an insert area, according to one or more embodiments.

In one or more embodiments, the shape of the insert area 13 may be arbitrarily selected as long as the display of the line 30 is suppressed. In one or more embodiments, as illustrated in FIG. 7, the insert area 13 may comprise a plurality of rectangular areas spaced from each other in the direction orthogonal to the scan lines L. In one or more embodiments, as illustrated in FIG. 8, the insert area 13 may comprise a plurality of rectangular areas spaced from each other in the direction in which the scan lines L are extended. In one or more embodiments, as illustrated in FIG. 9, the insert area 13 comprises a plurality of parallelogramic areas spaced from each other in the direction in which the scan lines L are extended. In one or more embodiments, the insert area 13 is the entirety of an invalid area 12.

Embodiments are not limited to examples in which the image processing circuitry 22 of the display driver 2 sets the pixel data associated with the pixels in the invalid areas 12 other than the insert area 13 to the first grayscale values. In one or more embodiments, the host 200 may set the pixel data associated with the pixels of the boundary areas 14 and the invalid areas 12 to first grayscale values representing black or the like. In such embodiments, the display driver 2 may set invalid pixel data associated with the insert area 13 to the second grayscale values, not modifying the grayscale values of the invalid pixel data associated with the invalid areas 12 other than the insert area 13.

In one or more embodiments, when the invalid pixel data associated with the pixels in the invalid areas 12 are not set to grayscale values representing black in the image data supplied by the host 200, the invalid pixel data associated with the pixels in the insert area 13 may not to be modified. In such embodiments, the invalid pixel data associated with the pixels in the insert area 13 in the display image data supplied to the source drive circuitry 23 may comprise grayscale values set to the invalid pixel data associated with the pixels in the insert area 13 in the image data obtained from the host 200.

Figure 10:
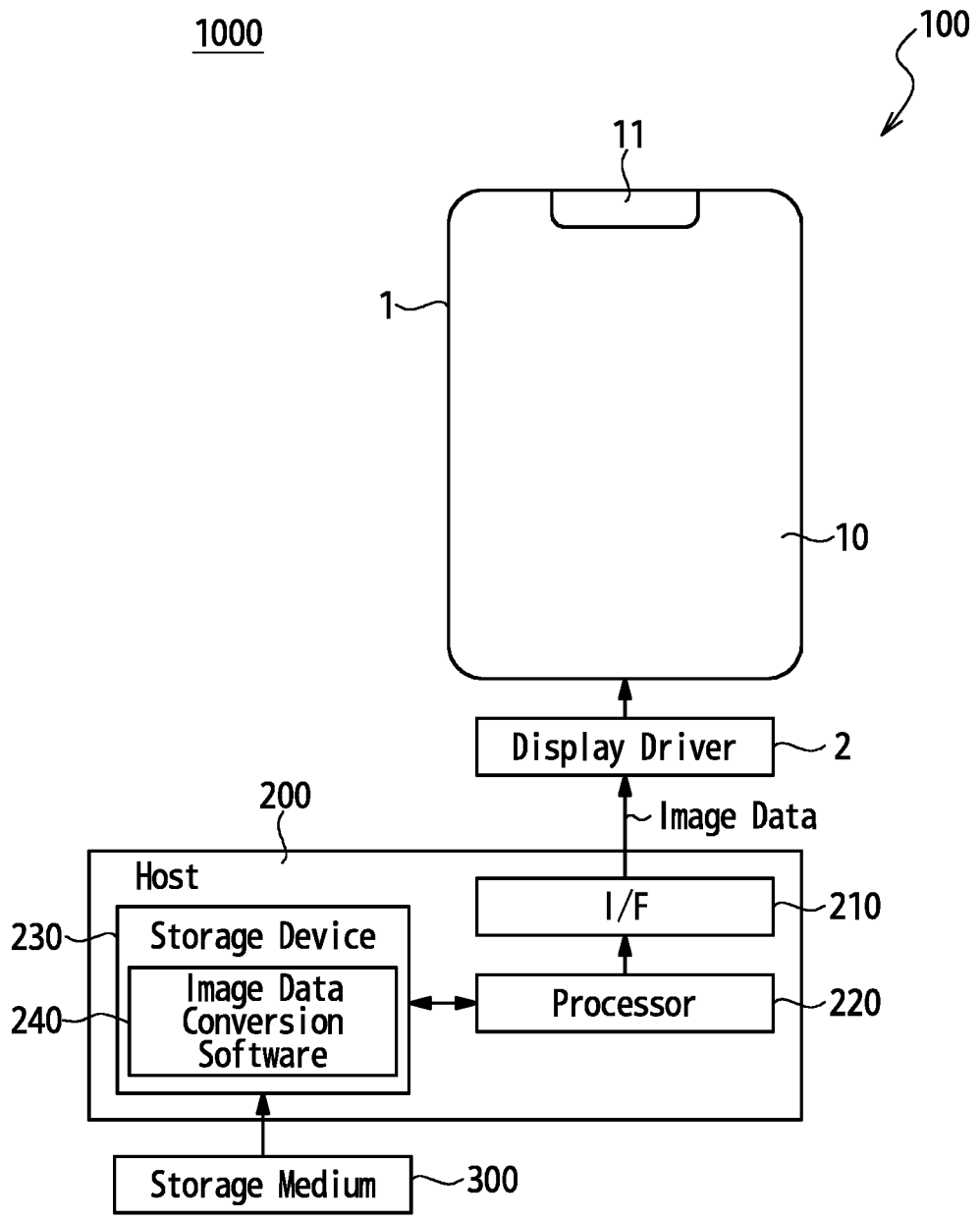
FIG. 10 illustrates an example configuration of a host, according to one or more embodiments.

In one or more embodiments, the host 200 may set effective pixel data associated with pixels in the boundary areas 14 to the first grayscale values and invalid pixel data associated with pixels in the insert area 13 to the second grayscale values in the image data to be transmitted to the display driver 2, as illustrated in FIG. 5. In such embodiments, the host 200 may generate the display image data through software-based processing. In one or more embodiments, as illustrated in FIG. 10, the host 200 comprises an interface 210, a processor 220, and a storage device 230.

In one or more embodiments, the interface 210 is electrically connected to the display driver 2 and the processor 220 and configured to transmit an image data generated by the processor 220 to the display driver 2.

In one or more embodiments, the storage device 230 is configured to store various data used for the generation of the display image data. In one or more embodiments, image data conversion software 240 is installed on the storage device 230, and the storage device 230 is used as a non-transitory tangible storage medium that stores therein the image data conversion software 240. The image data conversion software 240 may be offered in the form of a computer program product recorded in a computer-readable storage medium 300 or a computer program product downloadable from a server.

In one or more embodiments, the processor 220 is configured to execute the image data conversion software 240 to perform various data processes to generate the display image data. In one or more embodiments, the processor 220 is configured perform the same processing to that performed by the image processing circuitry 22 as described above in connection with FIG. 1 and transmit the generated display image data to the display driver 2. In one or more embodiments, as illustrated in FIG. 6, the processor 220 obtains an original image data to be displayed on the display panel 1 in step S10. The original image data may be generated by the processor 220 by using software different from the image data conversion software 240. In one or more embodiments, in step S20, the processor 220 obtains the positions of the invalid areas 12 and the boundary areas 14, and grayscale values to be set to pixel data of a display image data to be supplied to the display driver 2. In one or more embodiments, the positions of the invalid areas 12 and the boundary areas 14, and the grayscale values to be set to the pixel data are registered in advance in the storage device 230 as described in connection with FIG. 1. In one or more embodiments, the processor 220 generates the display image data based on the original image data, the positions of the invalid areas 12 and boundary areas 14, and the grayscale values to be set to the pixel data in step S30. In one or more embodiments, the display image data thus generated is transmitted to the display driver 2. In one or more embodiments, the first grayscale values and the second grayscale values to be set to the pixel data may be determined in accordance with the above-described embodiments. In such embodiments, the display driver 2 may drive the respective pixels of the display panel 1 based on the received display image data without performing the processing illustrated in FIG. 6. In one or more embodiments, the display image data may be generated by an image generation device other than the host 200.

In one or more embodiments, differently from the above-described embodiments in which the display image data is generated in units of pixels each comprising red, green and blue subpixels, the display image data may be generated in units of subpixels when the shapes of the display areas of the display panel 1 for the respective colors of the subpixels are different. In one or more embodiments, the grayscale values to be set to the pixel data of the display image data may be arbitrarily selected as long as the display of the line 30 is suppressed, differently from the above-described embodiments in which the pixel data associated with the pixels in the insert area 13 are set to the second grayscale values and the pixel data associated with the pixels in the boundary areas 14 are set to the first grayscale values.

Although various embodiments of this disclosure have been specifically described in the above, a person skilled in the art would appreciate that the technologies disclosed herein may be implemented with various modifications.

What is claimed is:

1. A display driver, comprising:

image processing circuitry configured to output display image data representing a display image comprising an effective area to be displayed in a display area of a display panel and an invalid area not to be displayed in the display area; and drive circuitry configured to drive the display panel based on the display image data, wherein the display image data comprises:

effective pixel data associated with first pixels in the effective area; and invalid pixel data associated with second pixels in the invalid area, wherein the effective pixel data associated with one or more of the first pixels is set to first grayscale values, the one or more of the first pixels located within a boundary area adjacent to the invalid area, and wherein the invalid pixel data associated with one or more of the second pixels is set to second grayscale values, the one or more of the second pixels located within an insert area defined in the invalid area, the second grayscale values comprising a value different from the first grayscale values.

2. The display driver according to claim 1, wherein a boundary between the effective area and the invalid area comprises a line segment parallel to a scan line of the display panel.

3. The display driver according to claim 2, wherein the insert area is aligned to at least a portion of the line segment of the boundary.

4. The display driver according to claim 1, where the image processing circuitry is further configured to set the effective pixel data associated with the one or more of the first pixels located within the boundary area to the first grayscale values.

5. The display driver according to claim 1, where the image processing circuitry is further configured to set the invalid pixel data associated with the one or more of the second pixels located within the insert area to the second grayscale values.

6. The display driver according to claim 1, wherein the second grayscale values are larger than the first grayscale values.

7. The display driver according to claim 1, wherein the second grayscale values comprises a maximum grayscale value.

8. The display driver according to claim 1, further comprising an interface configured to receive image data from a source external to the display driver, wherein the invalid pixel data associated with the one or more of the second pixels located within the insert area comprises grayscale values set to pixel data associated with the one or more of the second pixels in the received image data.

9. The display driver according to claim 1, wherein the first grayscale values comprises a minimum grayscale value.

10. The display driver according to claim 1, further comprising an interface configured to receive image data from a source external to the display driver, wherein the first grayscale values are determined based on third grayscale values set to pixel data associated with the one or more of the first pixels in the received image data.

11. The display driver according to claim 10, wherein the first grayscale values are determined by blending the third grayscale values with a fourth grayscale value.

12. The display driver according to claim 1, wherein the display image data is generated such that one or more the second pixels are located within the insert area, and wherein the one or more of the second pixels being adjacent to the effective area.

13. A non-transitory storage medium having a computer-readable program code embodied therewith, the computer-readable program code executable by one or more computer processors to generate display image data for driving a display panel based on original image data representing a display image comprising an effective area to be displayed in a display area of the display panel and an invalid area not to be displayed in the display area, wherein the display image data comprises:

effective pixel data associated with first pixels in the effective area; and invalid pixel data associated with second pixels in the invalid area, wherein generating the display image data comprises setting the effective pixel data associated with one or more of the first pixels to first grayscale values, the one or more of the first pixels located within a boundary area adjacent to the invalid area, and wherein the invalid pixel data associated with one or more the second pixels is set to second grayscale values, the one or more of the second pixels located within an insert area defined in the invalid area and the second grayscale values comprise a value different from the first grayscale values.

14. The non-transitory storage medium according to claim 13, wherein a boundary between the effective area and the invalid area comprises a line segment parallel to a scan line of the display panel.

15. The non-transitory storage medium according to claim 14, wherein the insert area is aligned to at least a portion of the line segment of the boundary.

16. The non-transitory storage medium according to claim 13, wherein generating the display image data comprises setting the invalid pixel data associated with the one or more of the second pixels located within the insert area to the second grayscale values.

17. The non-transitory storage medium according to claim 13, wherein the second grayscale values are larger than the first grayscale values.

18. The non-transitory storage medium according to claim 13, wherein the invalid pixel data associated with the one or more of the second pixels located within the insert area comprises grayscale values set to pixels data associated with the one or more of the second pixels in the original image data.

19. A method, comprising:

generating display image data for driving a display panel based on an original image data representing a display image comprising an effective area to be displayed in a display area of the display panel and an invalid area not to be displayed in the display area, wherein the display image data comprises:

effective pixel data associated with first pixels in the effective area; and invalid pixel data associated with second pixels in the invalid area, wherein generating the display image data comprises:

setting the effective pixel data associated with one or more of the first pixels to first grayscale values, the at least some of the first pixels located within a boundary area adjacent to the invalid area, and setting the invalid pixel data associated with one or more of the second pixels to second grayscale values, the one or more of the second pixels located within an insert area defined in the invalid area, and wherein the second grayscale values comprises a value different from the first grayscale values.

20. The method according to claim 19, wherein the second grayscale values are larger than the first grayscale values.

* * * * *